United States Patent [19]

Herden

[11] Patent Number: 4,653,459

[45] Date of Patent: Mar. 31, 1987

[54] METHOD AND APPARATUS FOR IGNITING A COMBUSTIBLE MIXTURE, ESPECIALLY GASOLINE-AIR IN THE COMBUSTION CHAMBER OF AN INTERNAL COMBUSTION ENGINE

[75] Inventor: Werner Herden, Gerlingen, Fed. Rep. of Germany

[73] Assignee: Robert Bosch GmbH, Stuttgart, Fed. Rep. of Germany

[21] Appl. No.: 794,119

[22] Filed: Nov. 1, 1985

Related U.S. Application Data

[63] Continuation-in-part of Ser. No. 643,464, Aug. 23, 1984, abandoned.

[51] Int. Cl.[4] ..... F02P 1/00

[52] U.S. Cl. ..... 123/637; 123/636

[58] Field of Search ..... 123/636, 637, 440, 489

[56] References Cited

U.S. PATENT DOCUMENTS

| | | | |
|---|---|---|---|
| 3,926,165 | 12/1975 | Merrick | 123/636 |
| 3,926,557 | 12/1975 | Callies | 123/636 |
| 3,945,362 | 3/1976 | Snow | 123/637 |
| 3,983,461 | 3/1976 | Jordan . | |
| 4,091,787 | 5/1978 | Frank | 123/637 |
| 4,112,898 | 9/1978 | Manger | 123/636 |
| 4,341,195 | 4/1982 | Nishio et al. . | |
| 4,428,349 | 1/1984 | Neumann | 123/637 |

*Primary Examiner*—Ronald B. Cox

*Attorney, Agent, or Firm*—Frishauf, Holtz, Goodman, Woodward

[57] ABSTRACT

The energy transfer derived from the ignition spark in the first or breakdown phase of a sparking event is matched to the speed of propagation of the ignition or flame front within the combustion chamber of an internal combustion engine (ICE) 11. The number of spark flash-overs or breakdowns is made dependent on the conditions of the combustible mixture applied to the ICE, for example by providing signals representative of the mixture by sensing fuel and air throughput, as well as, preferably, speed, loading, and temperature of the engine. The so derived data are associated with numbers of spark breakdowns or flash-overs resulting in optimum combustion; the course of combustion itself can be sensed, for example, by a pressure, light or ion current sensor coupled to the combustion chamber, and the resulting combustion event compared with stored data in the memory which, then, provides output signals to a function generator to associate any derivation from optimum combustion with a number of spark breakdown occurrences to establish optimum combustion conditions.

8 Claims, 2 Drawing Figures

METHOD AND APPARATUS FOR IGNITING A COMBUSTIBLE MIXTURE, ESPECIALLY GASOLINE-AIR IN THE COMBUSTION CHAMBER OF AN INTERNAL COMBUSTION ENGINE

This application is a continuation-in-part of application Ser. No. 06/643,464, filed Aug. 23, 1984, abandoned.

The present invention relates to a method and apparatus to ignite a combustible gaseous mixture, particularly a mixture of gasoline vapor and air in the combustion chamber of an internal combustion engine utilizing a sparkplug.

BACKGROUND

Ignition of a fuel-air mixture in the combustion chamber of an internal combustion engine (ICE) of the Otto-type is done by means of a sparkplug in which a high-voltage spark, for example generated by discharge of a capacitor, is caused to discharge across a firing or spark gap of the sparkplug. The capacitor, or another engergy storage device such as an ignition coil itself, is charged with energy and, at a predetermined time instant which may be controlled by a computer, the capacitor or other energy storage device discharges causing the spark to flash over at the spark gap. The spark gap ignites the combustible mixture within the combustion chamber of the ICE.

Timing of the spark in relation to the combustible charge, and the position of a piston in the ICE, usually taken with reference to the top dead-center (TDC) position of the piston, is important. The spark flash over is usually caused to occur at a predetermined time instant in advance of (TDC) position of the piston so that the mixture will burn, and give off energy just at and after the piston has reached TDC position, to obtain maximum efficiency from the burning mixture. For most efficient operation, it is important that the mixture should burn as rapidly as possible within the combustion chamber, and that a frontal zone of combustion, or flaming, of the combusitible mixture propagates as rapidly as possible.

The electrical discharge which occurs at the spark gap of the sparkplug under control of the associated ignition system is, unfortunately, not a clearly analyzable occurrence or event as, for example, an electrical square-wave pulse or the like which controls the discharge. As the spark gap forms, three phases can be distinguished:

(1) the breakdown phase;

(2) the arcing phase; and (3) the glow phase.

The energy transferred in the various ones of the phases differs greatly. The formation of the respective phases depends to some extent on the geometry of the ignition electrodes, as well as on the associated circuitry connected thereto. If the ignition system provides a high-voltage pulse to the ignition electrodes, then, first, after the breakdown voltage has been exceeded, an electically conductive plasma path will result. The currents which flow through the path between the electrodes may be high. This occurs during phase (1), that is, the breakdown phase.

The next phase is the arcing phase, the formation and course of which depends to some extent on the circuitry with which the sparkplug is associated. The arcing phase causes current to flow in the previously generated plasma path. The voltage between the electrodes may be comparatively low or the current which flows at the beginning of the second, or arcing phase may be very high. When the current during the arcing phase drops below a predetermined value, the arc will extinguish. The third, or glow phase will follow. The current during the third or glow phase also flows through the plasma which has previously been generated. The voltage is above the value of the voltage during the arcing phase.

The sparkplug is stressed differentially during the respective phases. In the breakdown phase, the heat loading on the sparkplug is low. In the arcing phase, the heat loading is high, and heat which is applied to the ignition elecrodes of the sparkplug leads to the well-known erosion and deterioration of the sparkplug.

It has been found that the volume of the mixture of combustible gases which is activated and then ignited by the flash-over of the spark during the sparking phase is highest during the breakdown phase, and higher than during the arcing phase or the glow phase of the overall discharge of the sprakplug. Thus, the breakdown phase causes the most rapid reaction of the combustible mixture to the spark. The reliability of ignition, that is, the assurance that the spark will cause ignition of the combustible mixture is highest in the breakdown phase, and higher than during the arcing and the glow phase. If the mixture has not ignited during the breakdown phase of the spark, it may not ignite during the subsequent phase even if some plasma has formed.

In order to ensure reliable ignition, it is desirable that as much of the ignition energy as possible should be supplied during the breakdown phase of the sparkplug arc. Various arrangements to accomplish this aim have been proposed, see, for example, German patent publication document DE-OS No. 28 10 159. As described in this publication, the energy transfer is concentrated during the discharge phase, that is, during the initial phase of the spark at the head of the sparkplug. The system stabilizes ignition of the mixture and accelerates the speed, of the flame front which occurs during ignition, in comparison to prior systems and apparatus.

The loading conditions applied to an Otto-type ICE result in different conditions of combustible mixtures in the combustion chamber. Upon full load operation, the mixture is rich and the degree of fill of the combustion chamber is high. Igniting such a mixture does not pose any problems. An accelerated transfer of energy is not even necessarily desired. If the ICE, however, operates at low loading, or under idling condition or, even under engine braking conditions, the temperature within the combustion chamber drops rapidly and the pressure also drops. The mixture is lean, and the degree of fill of the combustion chamber of the ICE is low. Non-homogeneties of the mixture occur, and consequently, ignition of the already lean, and possibly non-homogenous and insufficiently filled, mixture may cause difficulties.

THE INVENTION

It is an object to match the ignition energy to practically any composition of mixture in the fill of a combustion chamber, and particularly the fill of a combustion chamber in an ICE.

Various types of ignition systems provide a succession of spark breakdowns in order to ensure ignition of the combustible mixture in an ICE. In accordance with the present invention, an important operating parameter of the engine, namely the composition of the combustible fuel-air mixture, is sensed, and the number of spark flashovers, or breakdowns at the sparking electrodes of the sparkplug are controlled as a function of the ratio of fuel to air in the combustible fuel-air mixture.

The relationship of number of spark breakdowns to the fuel-air mixture composition being supplied of the engine is determined, and stored in a function memory which, for example, provides a number output for the spark discharges, given certain inputs which depend on the then-pertaining relationship of fuel to air in the combustible mixture, as well as other operating conditions or parameters of the engine.

The system has the advantage that the propagation of the flame front, or ignition front, which occurs within the combustion chamber can be matched to practically any relationship of fuel to air in the fuel-air mixture, that is, any composition of the igniteable gas and, further, to other possibly occurring ambient conditions of the engine, such as temperature, engine operating speed, loading and the like.

In accordance with a preferred feature of the invention, various operating parameters of the engine, in addition to the composition of the fuel-air mixture, control the number of spark discharges and thus optimally match the propagating speed of the flame front within the combustion chamber to the then-pertaining operating parameters.

In accordance with a preferred feature of the invention, the number of spark discharges which is provided for operation of the engine under partial loading, low loading, idling, or even engine braking conditions is increased over that which occurs at full loading, or upon presence of a higher proportion of combustible material to combustion air, that is, a richer mixture of combustible gas in the combustion chamber.

When applied to an ICE, the various spark breakdowns should preferably follow each other rapidly; a spacing of about 200 microseconds between succeeding breakdown sparks has been found desirable. Controlling the first breakdown spark to occur at a commanded time instant and providing subsequent breakdown sparks, each, about 200 microseconds after the preceding spark increases the accuracy of overall ignition timing of the combustible gas in the combustion chamber. Control of the number of sparks which will occur based on operating parameters of the engine and/or the condition, that is, the fuel-air mixture relationship can easily be carried out automatically. The fuel-air mixture relationship, as well known, can be a functin of operating condition. In accordance with a preferred feature of the invention, it is sensed separately. Loading of the engine can be determined by sensing a position of a control element, such as an operator's fuel or gasoline control pedal; engine speed then is readily sensed. At a given loading and speed, an ascertainable quantity of fuel and mass of air is required to provide the combustible fuel-air mixture to the engine. The speed and loading parameters can be used as basic parameters to control the number of ignition sparks generated at the sparkplug; the fuel composition additionally controls the number of sparks at the sparkplug.

The system is particularly adaptable to spark discharge from a capacitor discharge system in which the capacitor is not completely discharged the first time, so that sequential ignition pulses resulting in sequential discharges, preferably about 200 microseconds apart, can be generated.

For effective and rapid application of capacitor energy to the spark gap, the capacitor is directly connected to the spark electrodes of the sparkplug; in accordance with a preferred embodiment of the invention, the capacitor is structurally integrated in the sparkplug.

DRAWINGS

FIG. 1 is a schematic block diagram of a system to control the number of spark discharges, or spark breakdowns, to ignite a fuel/air mixture in the combustion chamber of an internal combustion engine; and FIG. 2 is a block diagram showing details of a system to control the number of spark breakdowns.

DETAILED DESCRIPTION

Figure 1:
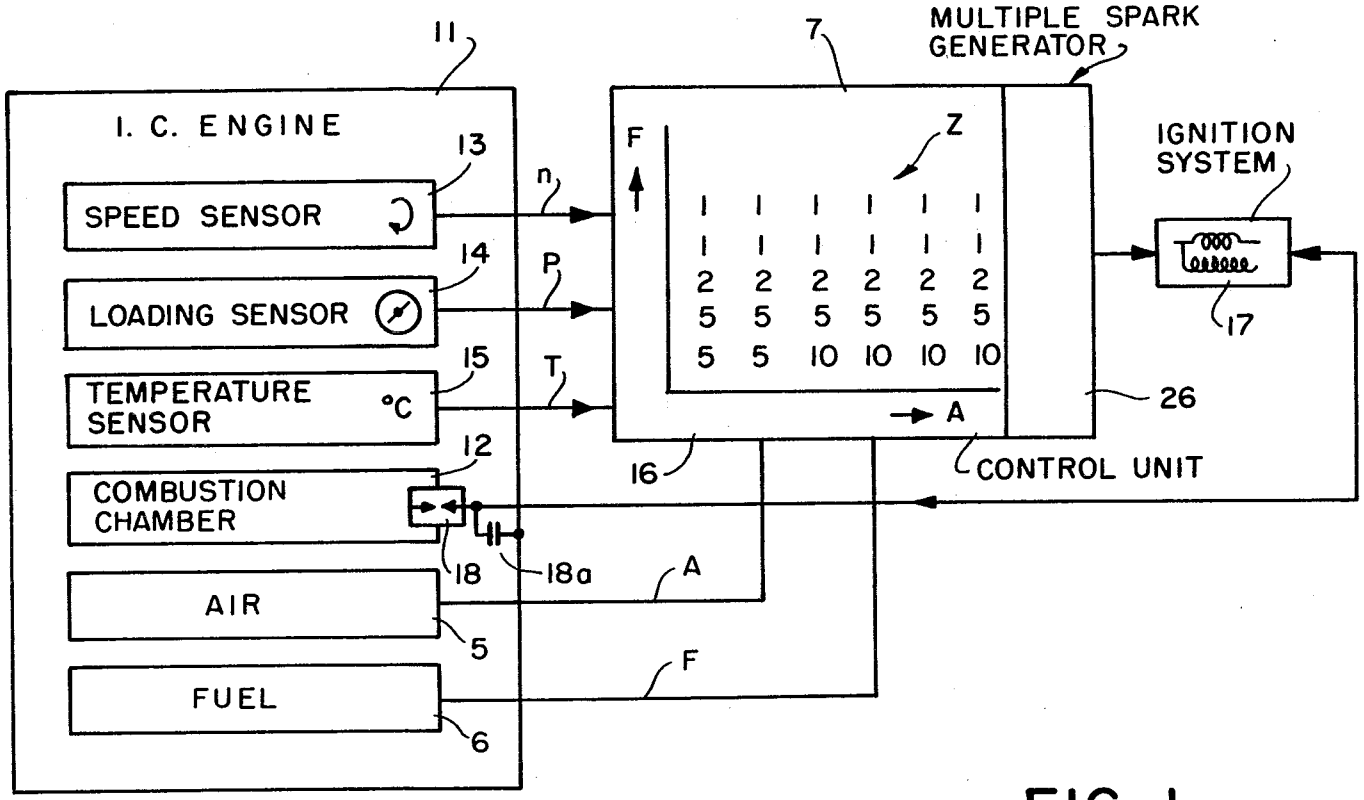

The invention will be descibed in relation to an Otto-type internal combustion engine (ICE), although it is not limited thereto. Application of the principle of the present invention to ignite combustible gases under other conditions, and for other purposes, will be apparent to those skilled in the art.

An ICE 1 (FIG. 1) has a combustion chamber shown schematically only at 12 into which a sparkplug 18 extends. The spark electrodes of the sparkplug 18 are shown schematically.

The ICE 11 is equipped with a plurality of sensors to sense its operating conditions, namely a speed sensor 13, which, preferably, has a reference element to provide a reference signal upon position, e.g., at a TDC position or a predetermined angular position in advance thereof. Further, a load sensor 14 is provided which, for example, may be a potentiometer, or a counter, providing an output signal representative of the position of the throttle of the ICE; preferably, a temperature sensor 15 is provided to furnish a temperature output signal representative of temperature of the ICE.

In accordance with a feature of the invention, a sensor 5 is provided sensing mass flow rate of air through the induction pipe or inlet manifold of the ICE. A sensor 6 senses the amount of fuel provided to the engine, the air and fuel being mixed, for example in an inlet manifold of the engine, as well known. The mass air flow can readily be sensed in accordance with well known technology, for example by a hot-wire sensor; the quantity of fuel can easily be sensed if the engine has a fuel injection system, which, in current technology, is usually electronically or electromechanically controlled, so that an electrical signal representative of fuel throughput during any one injection phase is available. In carburetor systems, the jet opening, as controlled by the positions of the carburetor nozzle control elements, such as nozzle valve pins, can be determined, for example by an electromechanical position transducer, so that the quantity of fuel as well as the quantity of air can be represented by an electrical signal. The electrical signals from sensors 5, 6 are then further processed as will appear.

The various output data from sensor 5, 6, 13, 14, 15 are applied to a control unit 16 which has a suitable inputs to receive the sensor output data. Unit 16 includes function-generating storage tables. Such tables, which can be stored in electronic Read-Only-Memories (ROMs), can relate various parameters, e.g. speed of the engine, represented by a signal n derived from speed sensor 13, to loading, represented by a loading signal P derived from load sensor 14. A temperature signal T, additionally, can be used to shift the table in accordance with temperature.

The air quantity, represented by a signal A, is related in a function generating storage table 7, retained for example in an ROM within unit 16 to a signal F from fuel sensor 6. An output number A will be obtained which is then used to modify the number of output pulses derived from a primary table (not shown) which relates speed and loading as represented by the signals n and P.

The number of output pulses, as determined by the speed-load table, and as further modified by a temperature signal T derived from the sensor 15 and by the value Z derived from the table 7 is then supplied to a multiple spark generator 26 which, in turn, is connected to an ignition system 17, for example an ignition coil. The ignition system 17 controls flashover of sparks at the electrodes of the spark plug 18 within the combustion chamber 12. In accordance with a feature of the invention, the sparks are generated by a discharge of a capacitor 18*a*, which is directly connected to the spark gap, preferably integrated within the spark plug itself. Spark plugs with integrated capacitors are known in the art. For most efficient operation of the system, no inductive elements, such as transformers, ignition coils and the like should be interposed between the capacitor 18*a* and the spark gap of the spark plug 18 itself. In accordance with a suitable construction, the capacitor 18*a* is formed by a metallic tubular element or sleeve within the spark plug, forming one electrode, the spark plug housing, connected to the engine chassis, forming the second electrode, as schematically indicated in FIG. 1.

The control unit 16 determines the number of spark breakdowns, dependent on the input signals derived from the sensors 5, 6, the table 7, and sensors 13, 14, 15 and the table in connection therewith (not shown). FIG. 1 illustrates the association of the number Z of the spark breakdowns in dependence on air and fuel quantity. The table 7 can be so arranged that specific numbers Z are generated in dependence on the ratio of fuel to air.

The capacitor 18*a* is charged to a suitable high voltage by the ignition system 17, as well known.

OPERATION

Depending on the signals derived from sensors 13, 14, 15, the control unit 16 will provide a control signal to the multiple spark generator in accordance with a stored table as well known, and as modified by table 7 within unit 16 in FIG. 1. At low loading, high speed, and a lean mixture (low fuel/air ratio), the number of spark breakdowns to be commanded by the multiple spark generator 26 for application by the ignition system 17 is high, for example ten breakdowns. To provide for a predetermined defined ignition instant with respect to the reference position of a piston, the time sequence of the individual breakdowns is small, and for a high number of breakdowns, the time sequence is preferably less than 200 microseconds.

If the fuel-air mixture changes towards a higher proportion of fuel, that is, when the mixture is enriched, other conditions remaining essentially equal—for example due to some increase in loading or as controlled by an exhaust emission control system, not shown, and as well known—the number of sparks may be reduced since the richer mixture will ignite more easily.

The system permits use of a table relating speed, fuel quantity and air quantity—possible as modified by temperature—without considering a signal based on throttle position—representative of loading. Control of the number of sparks is related to the composition of the combustible fuel-air mixture, so that only the table 7 need be used, speed and loading—and temperature, if desired—controlling only the instant of the first spark breakdown, that is, ignition timing or, in other words, the extent of spark advance. This control is far more accurate than an indirect control of parameters based on speed and loading alone. The actual combustion thus can be accurately controlled for optimum operating efficiency of the engine.

Figure 2:
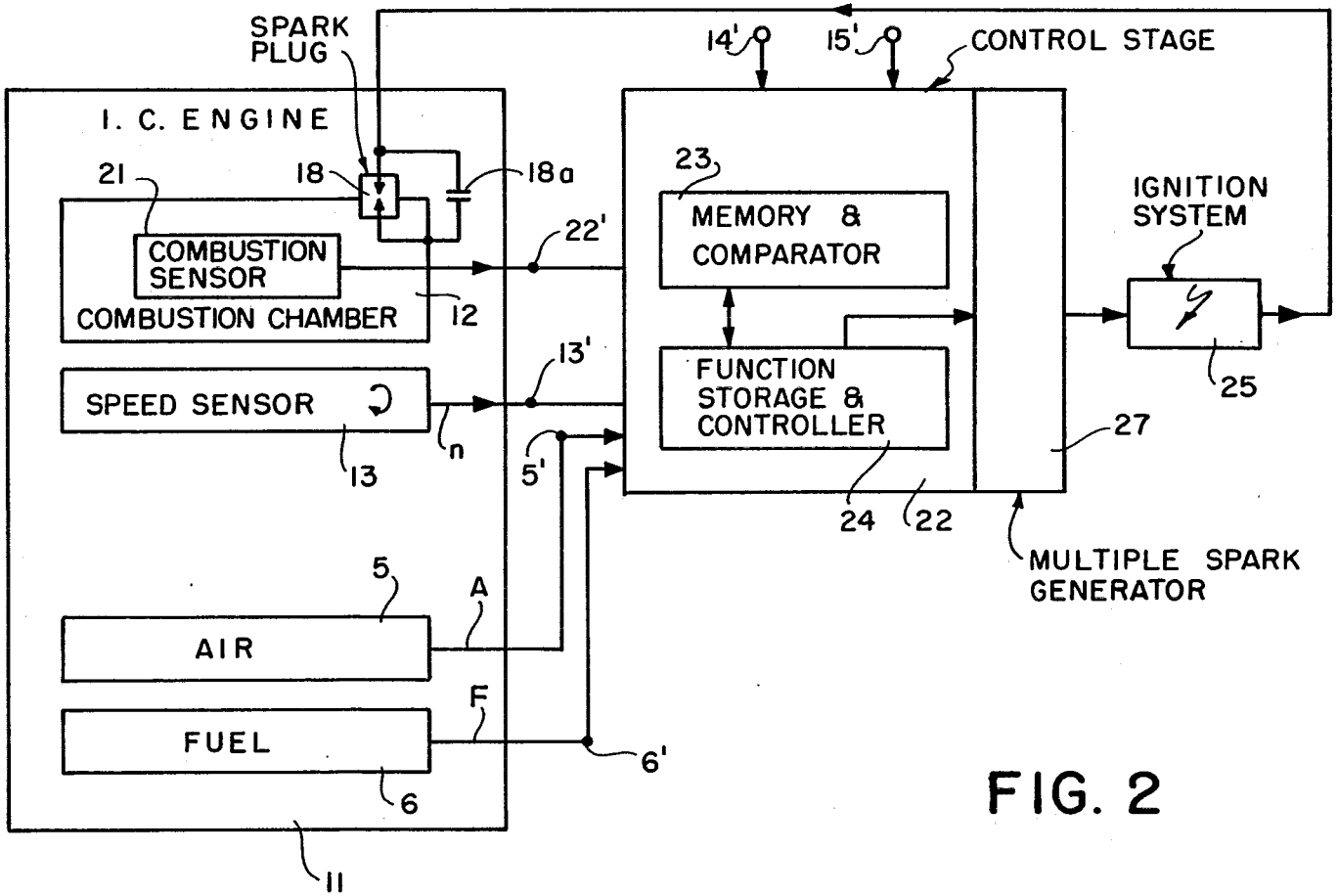

FIG. 2 is a detailed block diagram of a system to control the number Z of the spark flash-overs. The ICE 11 again is shown schematically, having at least one combustion chamber 12 with a sparkplug 18 and capacitor 18*a*. A speed sensor 13 is coupled to the ICE, which, preferably, provides a reference signal when the crankshaft at a particular angular position appears opposite a stationary pickup element of the sensor. Air and fuel quantity sensors are provided, as explained in connection with FIG. 1. A combustion sensor 21 is useful to provide a feedback output of the speed of combustion. It may be constructed, for example, in the form of combustion sensors which are also used in knock-sensing arrangements, for example an optical pickup, an ion current pickup, or a pressure pickup, which senses, respectively, a characteristic, such as light, ion current, or pressure within the combustion chamber 12.

The outputs from sensors 5, 6, 13, 21 are connected to input 5', 6', 13', 22' of the controller 22. Controller 22 includes a memory-and-comparator 23 and a function storage and controller unit 24. The output of the controller, which functions as a control stage, is connected to the multiple spark generator 27, which, in turn, is connected to the ignition system 25. Ignition system 25 controls flash-over of a spark at sparkplug 18. The control stage 22, additionally, may, but need not, have signals 14', 15' applied thereto, which, for example, are derived from a load sensor 14 or a temperature sensor 15 (FIG. 1).

The basic input parameters for the control stage 22 thus will be engine speed n, derived from the sensor 13, and data which are representative of the composition of the charge of the combustible mixture, such as data derived from the air quantity sensor 5 and the fuel quantity sensor 6. If needed, other data, e.g. data from the combustion sensor 21 and/or from load and temperature sensor can be applied to stage 22. The memory 23 includes a data memory or data storage, e.g. in the form of tables similar to table 7, FIG. 1, in which relationships relating the respective input signals to ideal combustion conditions are stored. The outputs derived by sensors 5, 6, 13 and 21—and, if provided, by sensors 14 and 15, are compared with the stored data in the memory—which can be a one-step comparison, so that the memory, itself, will function as a comparator. Differences between ideal conditions and actual conditions are then applied to the function storage and contoller 24 which will associate the differences between ideal, or stored conditions and actual conditions with the number of ignition pulses which are necessary to restore the ideal conditions, that is, to associate the respective ideal conditions with that number of spark breakdowns which provides optimum combustion of the fuel-air mixture.

The control algorithm for such an association is simple, and may be no more but the association of a particular difference in stored condition and actual condition of the data shown, for example, in the table 7 within unit 16 of FIG. 1, so that the number of spark flash-overs or spark breakdowns is determined as a function of deviation of actual conditions from stored ideal conditions in memory 23. The result of the control in accordance with the embodiment of FIG. 2 is the same as that in an embodiment of FIG. 1—except that FIG. 2 includes a closed loop due to sensing of actual combustion conditions by the sensor 21. The number of the spark breakdowns as determined in the control stage 22 is then applied to the sparkplug 18 via the multiple spark generator 27 and the ignition system 25.

The ignition system 17, typically including an ignition coil, and the ignition system 25 will provide a number Z' of pulses for an equal number of spark discharge events at the spark gaps of the sparkplugs 18 (FIGS. 1 and 2). In both examples, the number Z' may be any value between 1 and 10 for any one ignition event. To obtain the necessary number of spark breakdowns, a pulse multiplier, typically a multiple spark generator 26, is coupled to the output of the control unit 16, to actually generate the multiple pulses. The control stage 22 of FIG. 2 is coupled to the multiple spark generator 27. Generation of multiple sparks for a single ignition event, and at essentially a single ignition instant, is described in detail in U.S. Pat. No. 3,926,557.

An example of a suitable spark plug is described in U.S. application Ser. 649,989, HERDEN et al, filed Sept. 13, 1984, assigned to the assignee of this application.

I claim:

1. In an internal combustion engine (11), apparatus for igniting a combustible fuel-air mixture within the combustion space (12, 21) of the cylinder of the combustion engine (11), a sparkplug (18) having spark electrodes located in the combustion space (12, 21);

ignition spark generating apparatus (17, 26; 25, 27) coupled to the sparkplug;

and means to enhance energy output from the sparkplug for ignition during the breakdown phase of sparking of the sparkplug comprising means (5) for sensing air quantity being supplied to the engine and for providing an air quantity signal (A);

means (6) for sensing fuel quantity being supplied to the engine and for providing a fuel quantity signal (F);

a control unit controlling the number of breakdowns of spark flash-overs across electrodes of the sparkplug as a function of the output representative of the ratio of fuel to air;

an actual combustion sensor (21) sensing the course of combustion of the fuel-air mixture within the combustion space (12, 21) and providing an actual combustion output signal;

the control unit (16, 7; 22) including a memory (7, 23) connected to receive the fuel signal (F) and the air signal (A), relating fuel quantity and air quantity and providing an output representative of the ratio of fuel to air, said control unit (22) further including a memory-and-comparator unit (23), forming part of said memory (7) and a function storage-and-controller unit (24), the actual combustion signals being applied to the memory-and-comparator unit (23) for comparison with stored values therein, representative of ideal combustion, and providing a control signal to the function store-and-controller unit (24) upon deviation of the course of combustion, as sensed by the combustion sensor (21) from the stored values in the memory-and-comparator unit, the function store-and-controller unit providing an output signal representative of the number of sparking pulses to be applied to the spark electrodes of the spark plug, and a multiple spark generating unit (26, 27) connected to and controlled by the function store-and-controller unit (24) of the control unit (22) providing an output signal representative of the number of sparking pulses to be applied to the spark electrodes of the spark plug to provide optimum ignition of the combustible mixture under the then pertaining operating conditions of the engine.

2. Apparatus according to claim 1, further including at least one of:

an engine speed sensor (13) providing an engine speed signal (n);

a load sensor (14) providing an engine loading signal (P);

a temperature sensor (15) providing a temperature signal (T);

at least one of said signals being connected to the control unit (16, 7; 22), the control unit additionally relating the number of breakdowns or spark flash-overs at the electrodes of the sparkplug to the engine parameter represented by the respective signal connected to the control unit.

3. Apparatus according to claim 1, wherein the multiple spark generator, upon being controlled to provide sequential spark pulses, provides said sequential spark pulses spaced apart by up to about 200 microseconds.

4. Apparatus according to claim 2, wherein the multiple spark generator, upon being controlled to provide sequential spark pulses, provides said sequential spark pulses spaced apart by up to about 200 microseconds.

5. Apparatus according to claim 1, further including a source of high voltage (17, 25);

a capacitor (18*a*) coupled to said high-voltage source for charging therefrom, said capacitor being directly and essentially non-inductively connected to the spark electrodes of the spark plug (18) for generation of multiple sparks as controlled by said multiple spark generating unit (26, 27).

6. Apparatus according to claim 2, further including a source of high voltage (17, 25);

a capacitor (18*a*) coupled to said high-voltage source for charging therefrom, said capacitor being directly and essentially non-inductively connected to the spark electrodes of the spark plug (18) for generation of multiple sparks as controlled by said multiple spark generating unit (26, 27).

7. Apparatus according to claim 3, further including a source of high voltage (17, 25);

a capacitor (18*a*) coupled to said high-voltage source for charging therefrom, said capacitor being directly and essentially non-inductively connected to the spark electrodes of the spark plug (18) for generation of multiple sparks as controlled by said multiple spark generating unit (26, 27).

8. Apparatus according to claim 4, further including a source of high voltage (17, 25);

a capacitor (18*a*) coupled to said high-voltage source for charging therefrom, said capacitor being directly and essentially non-inductively connected to the spark electrodes of the spark plug (18) for generation of multiple sparks as controlled by said multiple spark generating unit (26, 27).

* * * * *